US007306487B1

(12) United States Patent
Chang

(10) Patent No.: US 7,306,487 B1
(45) Date of Patent: Dec. 11, 2007

(54) LOW CROSSTALK TRANSMISSION CONNECTOR

(75) Inventor: Ray Chang, Taipei Hsien (TW)

(73) Assignee: Telebox Industries Corp., Taipei Hsien (TW)

( * ) Notice: Subject to any disclaimer, the term of this patent is extended or adjusted under 35 U.S.C. 154(b) by 0 days.

(21) Appl. No.: 11/594,243

(22) Filed: Nov. 8, 2006

(51) Int. Cl.
*H01R 13/648* (2006.01)

(52) U.S. Cl. ..... 439/610; 439/676; 439/98

(58) Field of Classification Search ..... 439/607–610, 439/676, 701, 98
See application file for complete search history.

(56) References Cited

U.S. PATENT DOCUMENTS 6,811,438 B1 * 11/2004 Ko ..... 439/607
7,160,153 B1 * 1/2007 Huang ..... 439/610
7,165,996 B1 * 1/2007 Kao ..... 439/607
2006/0105632 A1 * 5/2006 Szczesny et al. ..... 439/610
2006/0205277 A1 * 9/2006 Gordon et al. ..... 439/610
2007/0032133 A1 * 2/2007 Kao ..... 439/607

* cited by examiner

*Primary Examiner*—Hien Vu
(74) *Attorney, Agent, or Firm*—Troxell Law Office, PLLC

(57) ABSTRACT

A low crosstalk transmission connector includes a housing that houses a metal spring plate, a load bar, a terminal module and a locating frame, a cable organizer, which has an axle hole that receives a 8-wire cable and 8 wire grooves that separate the 8 insulated wires of the cable, and a metal shield that accommodates the cable organizer and has a bottom clamping plate and a top clamping plate respectively hooked on the bottom and top sides of the housing to ensure high steadity. The $4^{th}$ and $6^{th}$ metal contact terminals and the $1^{st}$, $2^{nd}$, $3^{rd}$, $5^{th}$, $7^{th}$ and $8^{th}$ metal contact terminals of the terminal module have the respective front contact portions curved in two reversed directions to reduce crosstalk noise, thereby improving transmission quality.

3 Claims, 22 Drawing Sheets

LOW CROSSTALK TRANSMISSION CONNECTOR

BACKGROUND AND SUMMARY OF THE INVENTION

The present invention relates to electric transmission connectors and more particularly, to a low crosstalk transmission connector, which gets high steadity and, which reduces crosstalk noise to improve signal transmission quality by means of reversing the front contact portions of the $4^{th}$ and $6^{th}$ metal contact terminals.

FIG. 1 illustrates a transmission connector 92 according to the prior art. According to this design, the transmission connector 92 is comprised of a housing 921, a circuit board 922, a load bar 923, and a cable organizer 924. The load bar 923 and the cable organizer 924 are fixedly mounted on the top side of the circuit board 922. The circuit board 922 has protruding engagement blocks 9221 respectively engaged into respective locating holes 9211 on the housing 921. The load bar 923 carries 8 metal contact terminals 9231~9238. The metal contact terminals 9231, 9232, 9233, 9234, 9235, 9236, 9237,9238 each have a front end turned backwardly upwards in same direction. Because the metal contact terminals 9231, 9232, 9233, 9234, 9235, 9236, 9237,9238 are curved in same direction, crosstalk noise is inevitable during data signal transmission. Further, the installation of the parts of the transmission connector 92 is complicated. The frame structure's rigid is not excellent, therefore the transmission connector 92 does not get high steadity. Further, the transmission connector 92 has no shielding means to protect data transmission against electromagnetic interference.

The present invention has been accomplished under the circumstances in view. According to one aspect of the present invention, the low crosstalk transmission connector is comprised of an electrically insulative housing, a metal spring plate, a load bar, a terminal module, a locating frame, a cable organizer, and a metal shield. After the housing has been assembled with the metal spring plate, the load bar, the terminal module and the locating frame, the cable is inserted the metal shield and the cable organizer with the 8 insulated wires respectively set in respective wire grooves in the cable organizer, and then a bottom clamping plate of the metal shield is hooked in bottom hook holes of the housing and a top clamping plate of the metal shield is engaged into a retaining groove of the housing and hooked up with a hook of the housing, and therefore the transmission cable gets high steadity.

According to another aspect of the present invention, the front contact portions of the $4^{th}$ and $6^{th}$ metal contact terminals of the 8 metal contact terminals of the terminal module and the front contact portions of the $1^{st}$, $2^{nd}$, $3^{rd}$, $5^{th}$, $7^{th}$ and $8^{th}$ metal contact terminals of the 8 metal contact terminals of the terminal module are curved in two reversed directions to reduce crosstalk noise, thereby improving transmission quality.

DETAILED DESCRIPTION OF THE INVENTION

Figure 1:
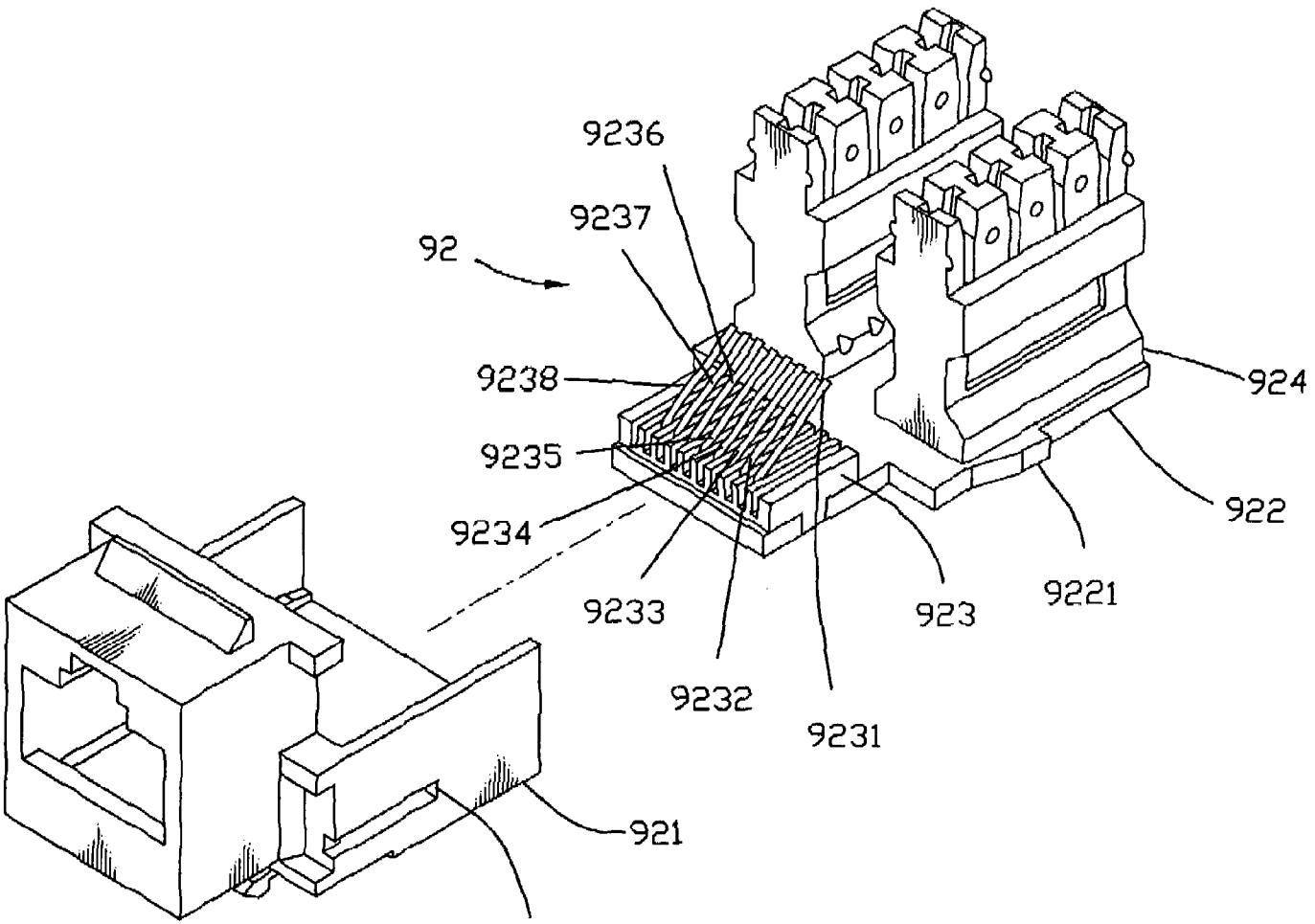
Fig.1 PRIOR ART
FIG. 1 is an exploded view of a transmission connector according to the prior art.
Figure 2:
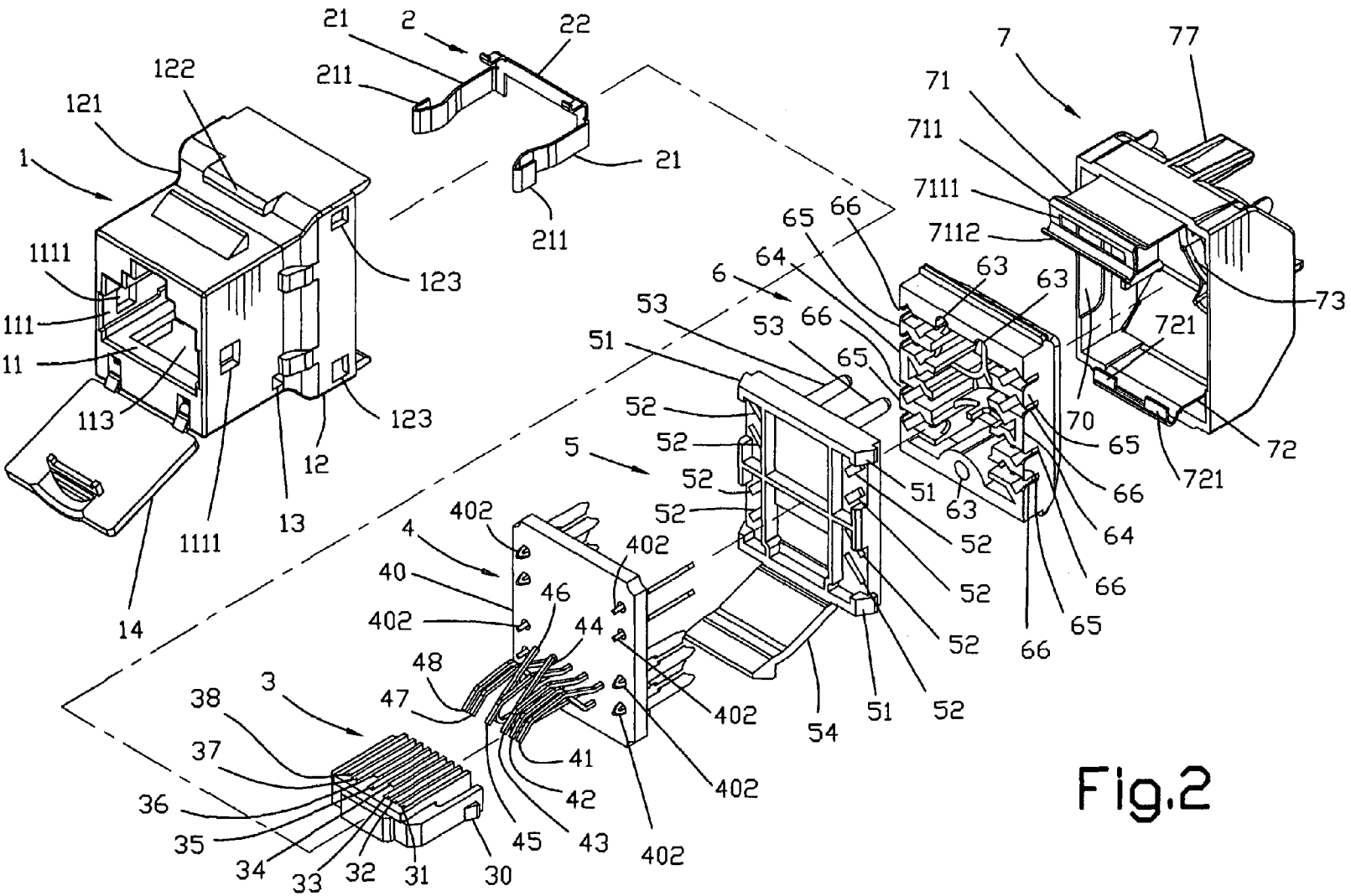
FIG. 2 is an exploded view of a low crosstalk transmission connector according to the present invention.
Figure 3:
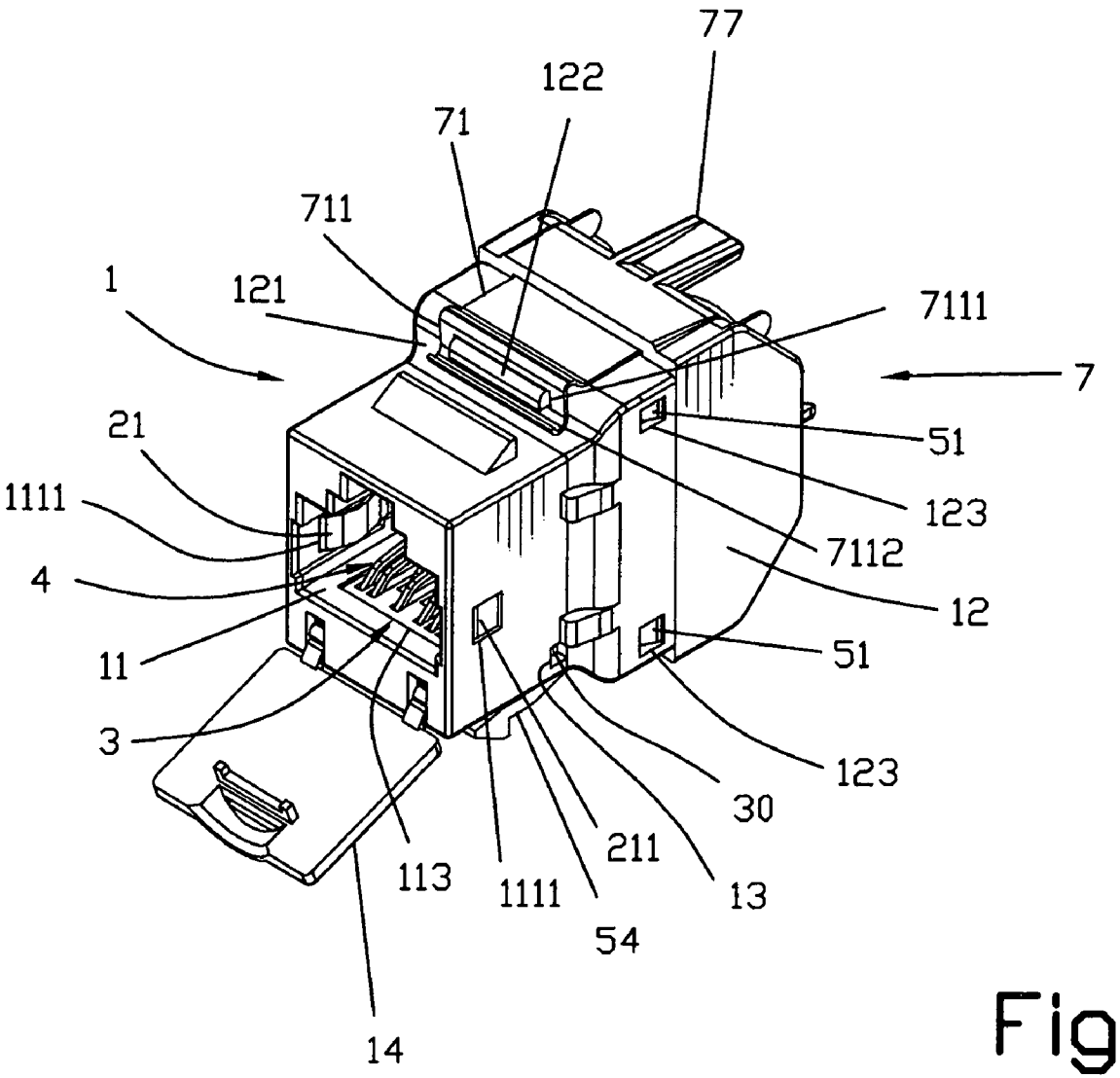
FIG. 3 is an elevational assembly of the low crosstalk transmission connector according to the present invention.
Figure 4:
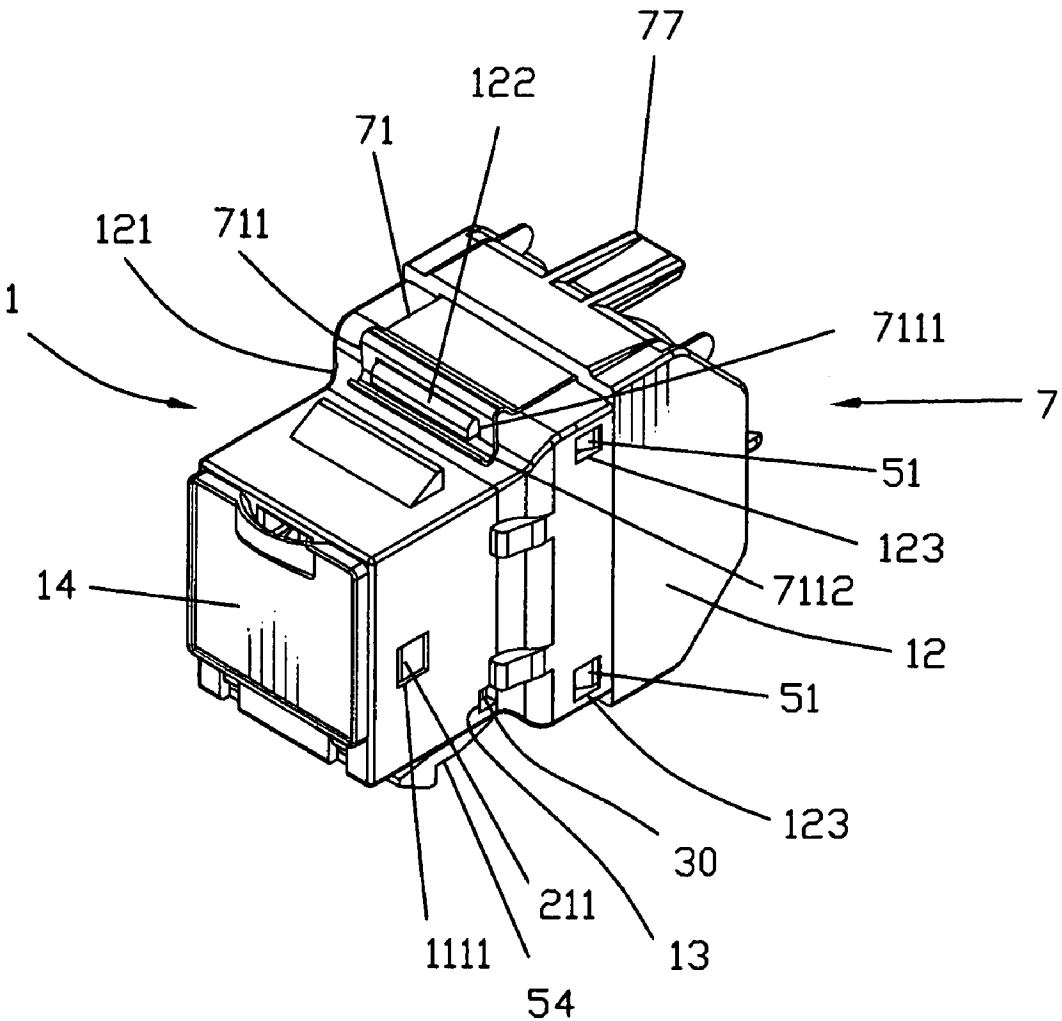
FIG. 4 corresponds to FIG. 3, showing the dust cover closed.
Figure 5:
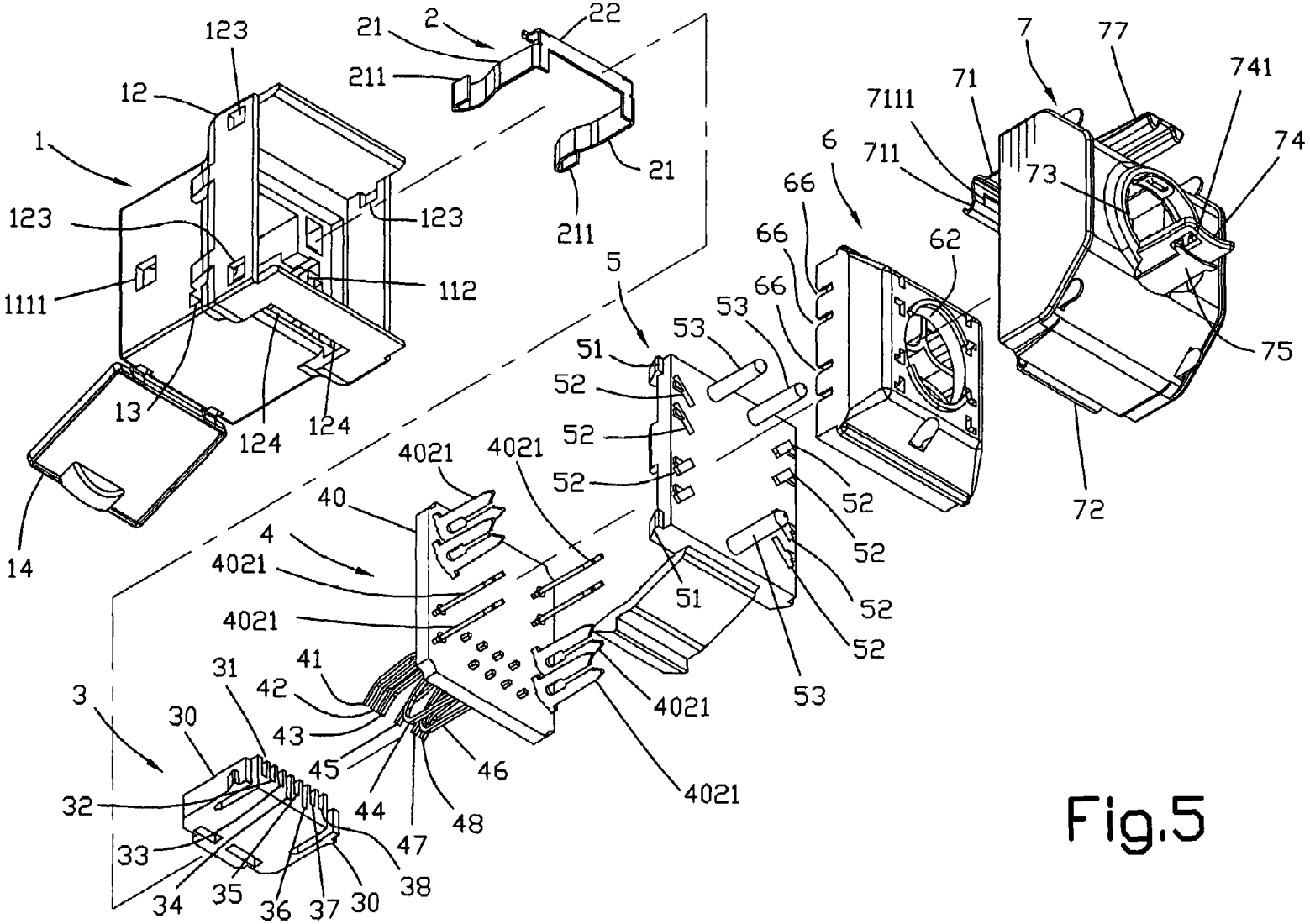
FIG. 5 corresponds to FIG. 3 when viewed from another angle.
Figure 6:
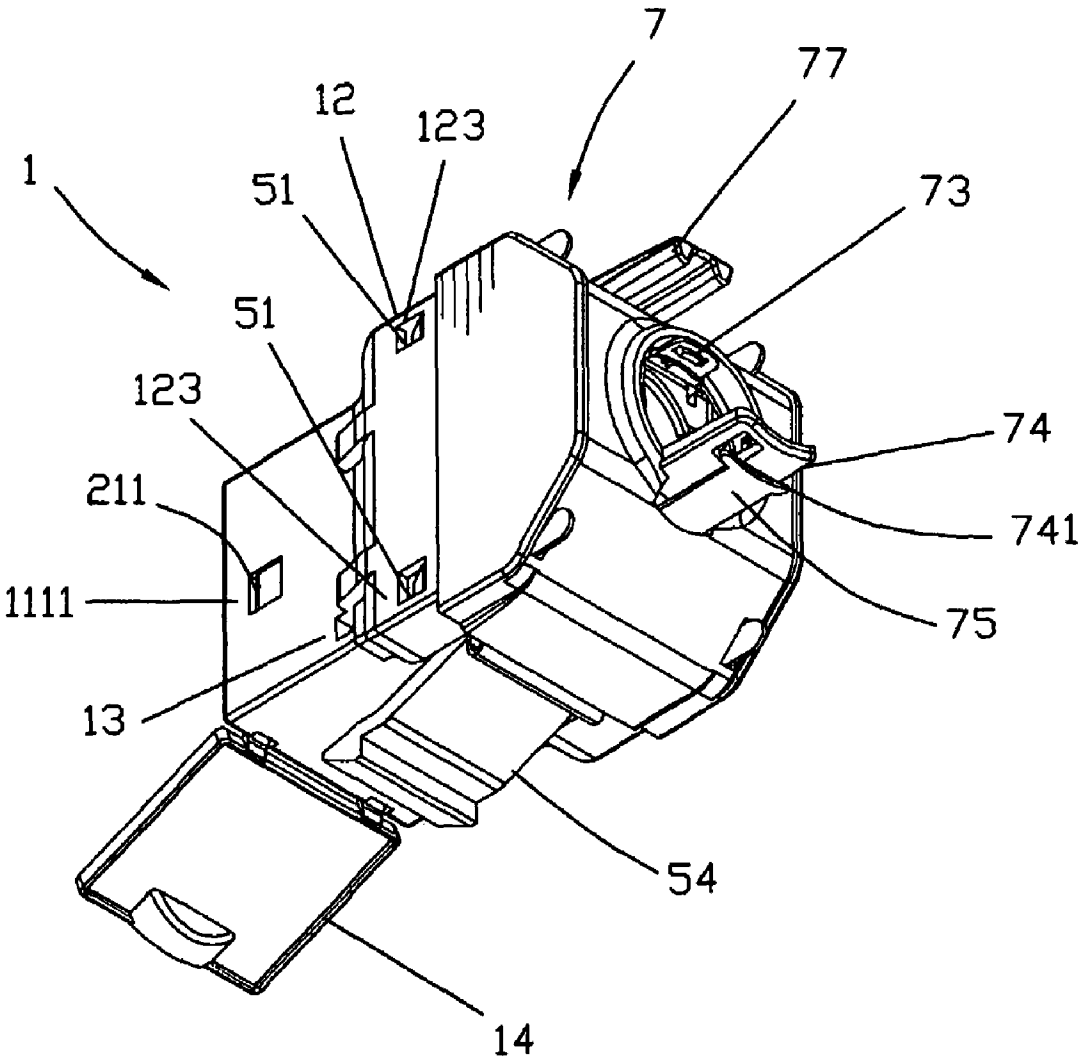
FIG. 6 corresponds to FIG. 3 when viewed from another angle.
Figure 7:
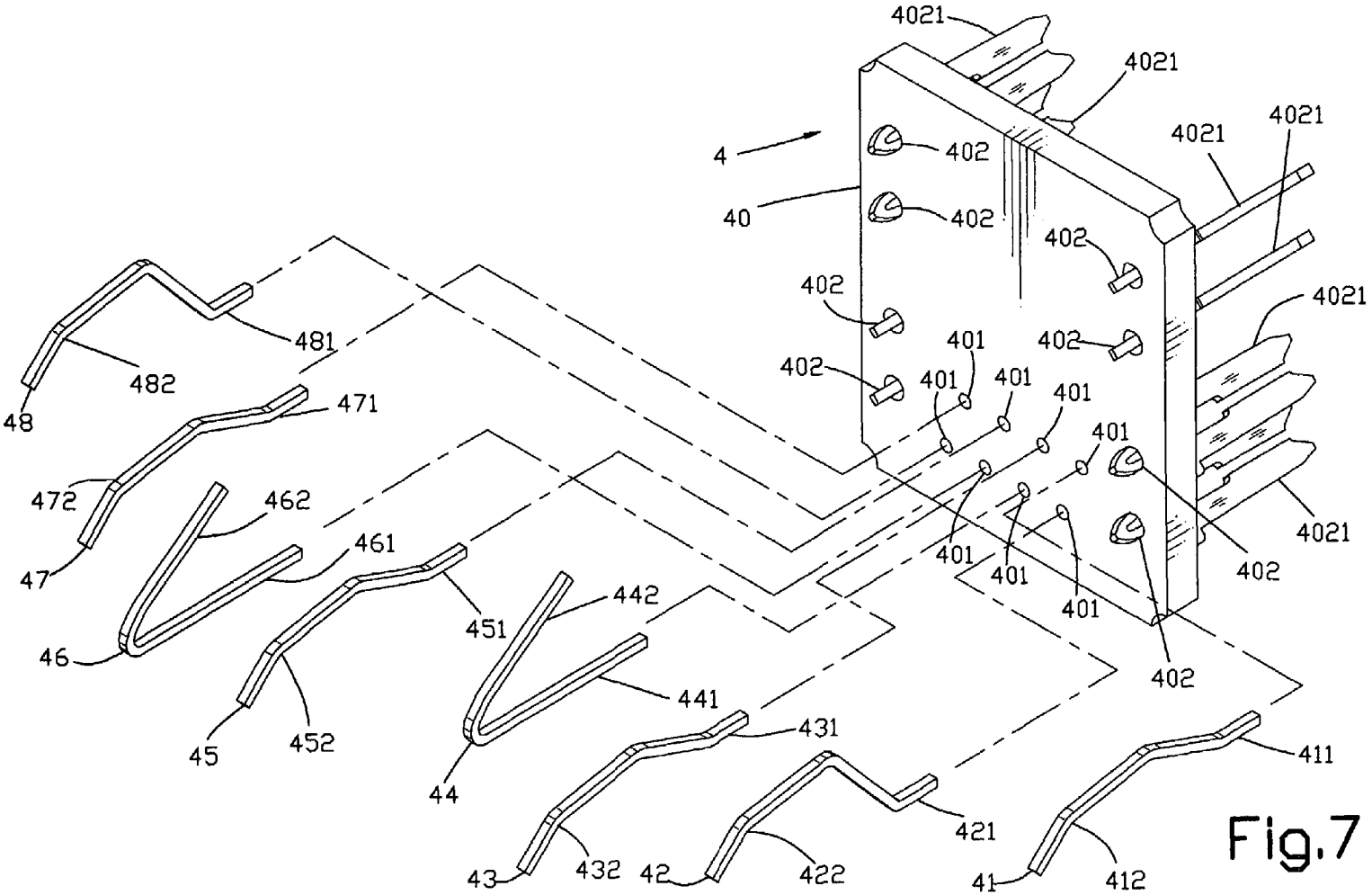
FIG. 7 is an exploded view in an enlarged scale of a part of the low crosstalk transmission connector according to the present invention.
Figure 8:
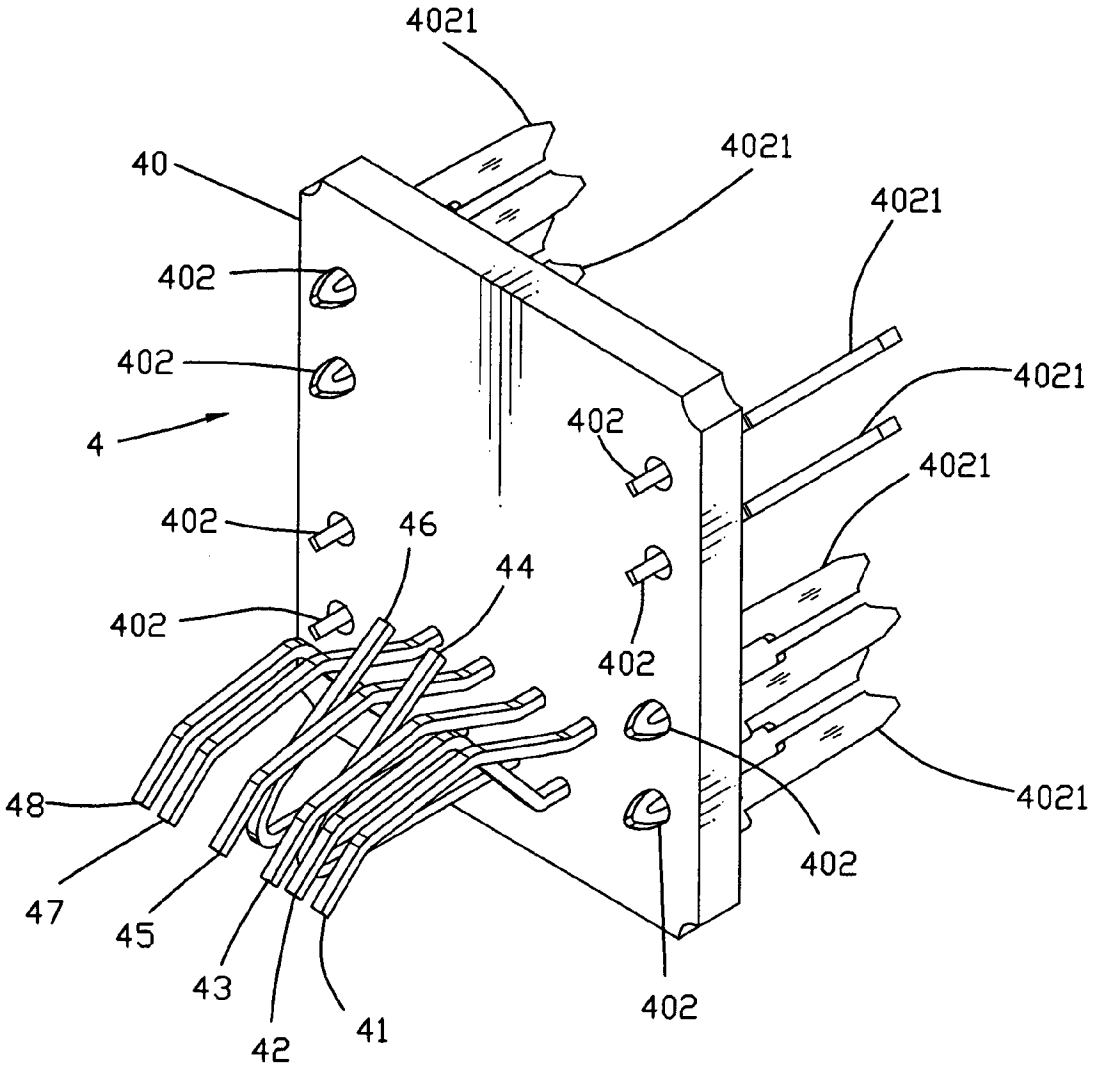
FIG. 8 is an elevational assembly view of FIG. 7.
Figure 9:
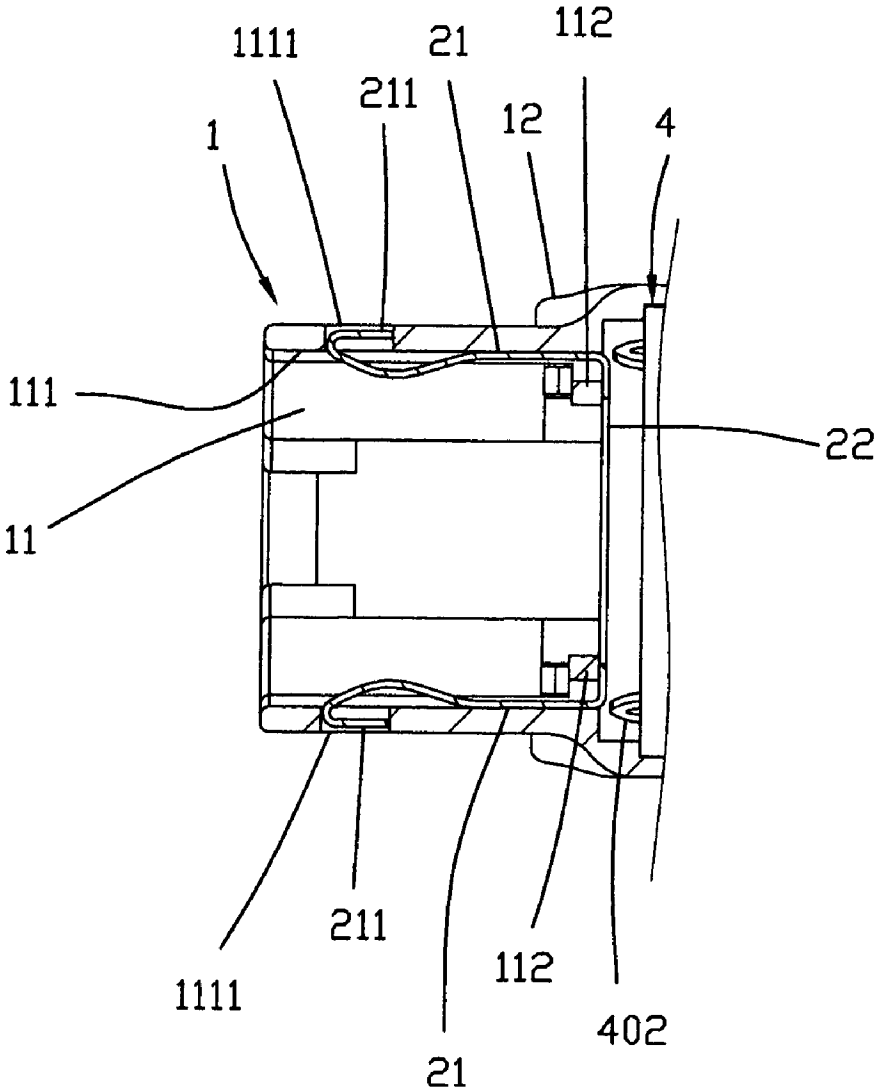
FIG. 9 is a schematic sectional view of a part of the low crosstalk transmission connector according to the present invention.
Figure 10:
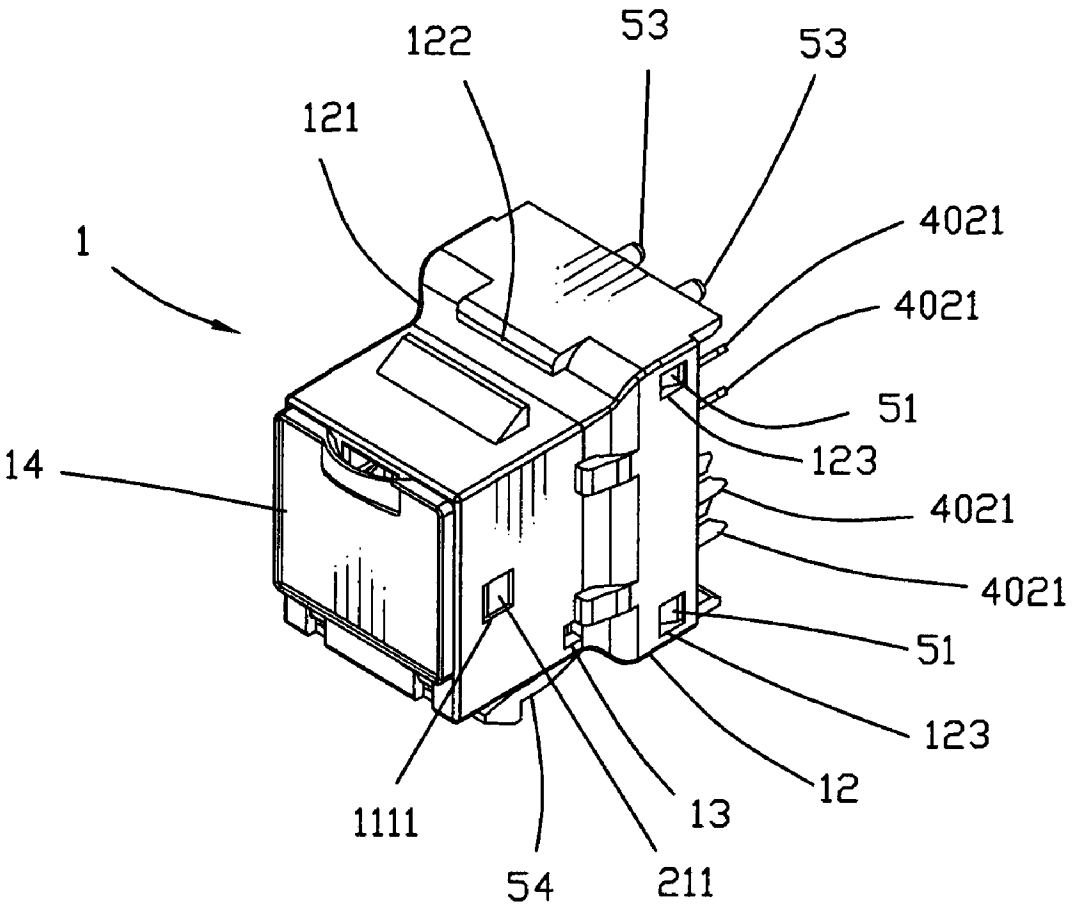
FIG. 10 is an elevational assembly view of a part of the present invention, showing the duct cover closed.
Figure 11:
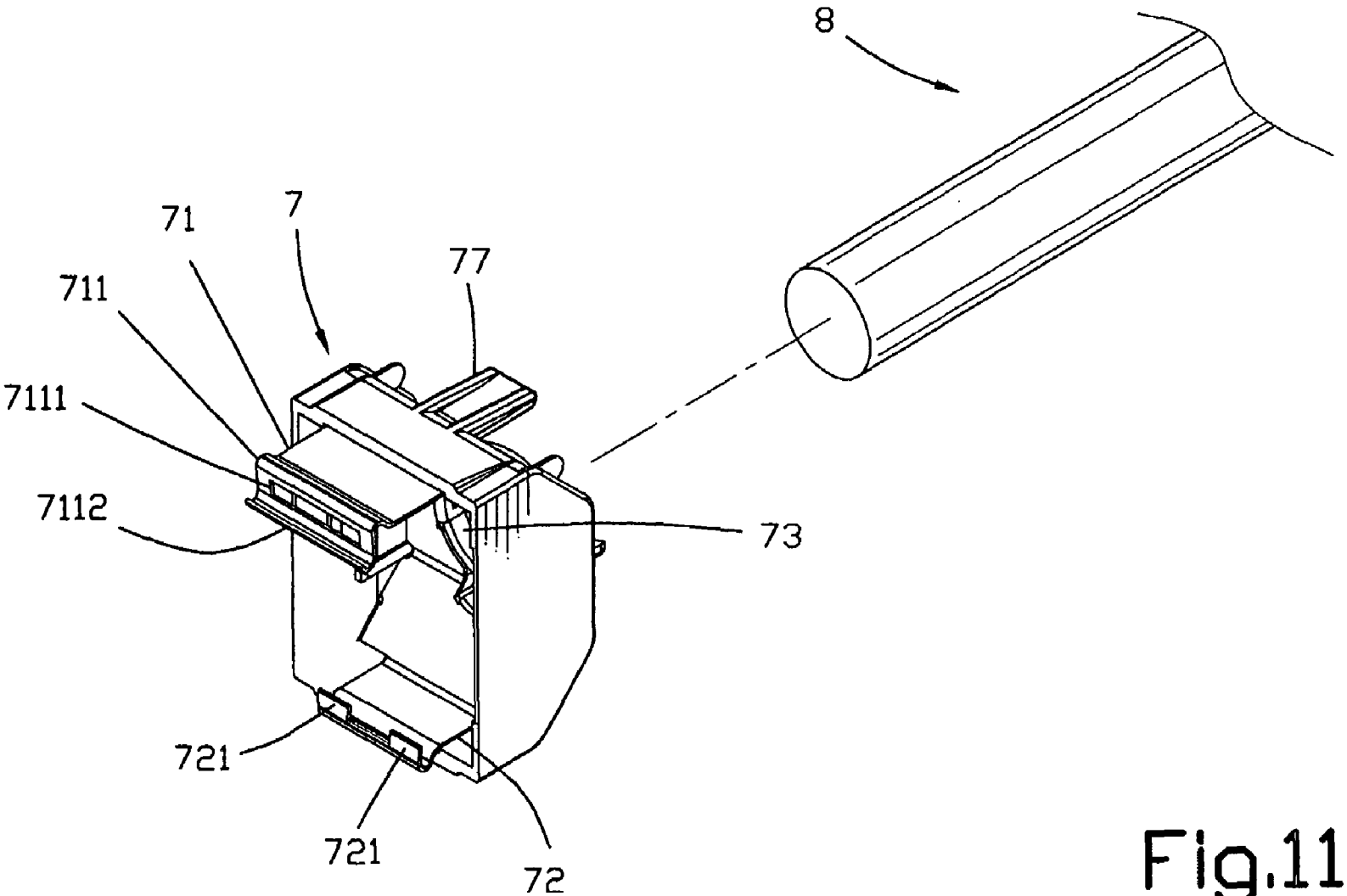
FIG. 11 is a perspective view of a part of the present invention, showing the structure of the metal shield before installation of the cable.
Figure 12:
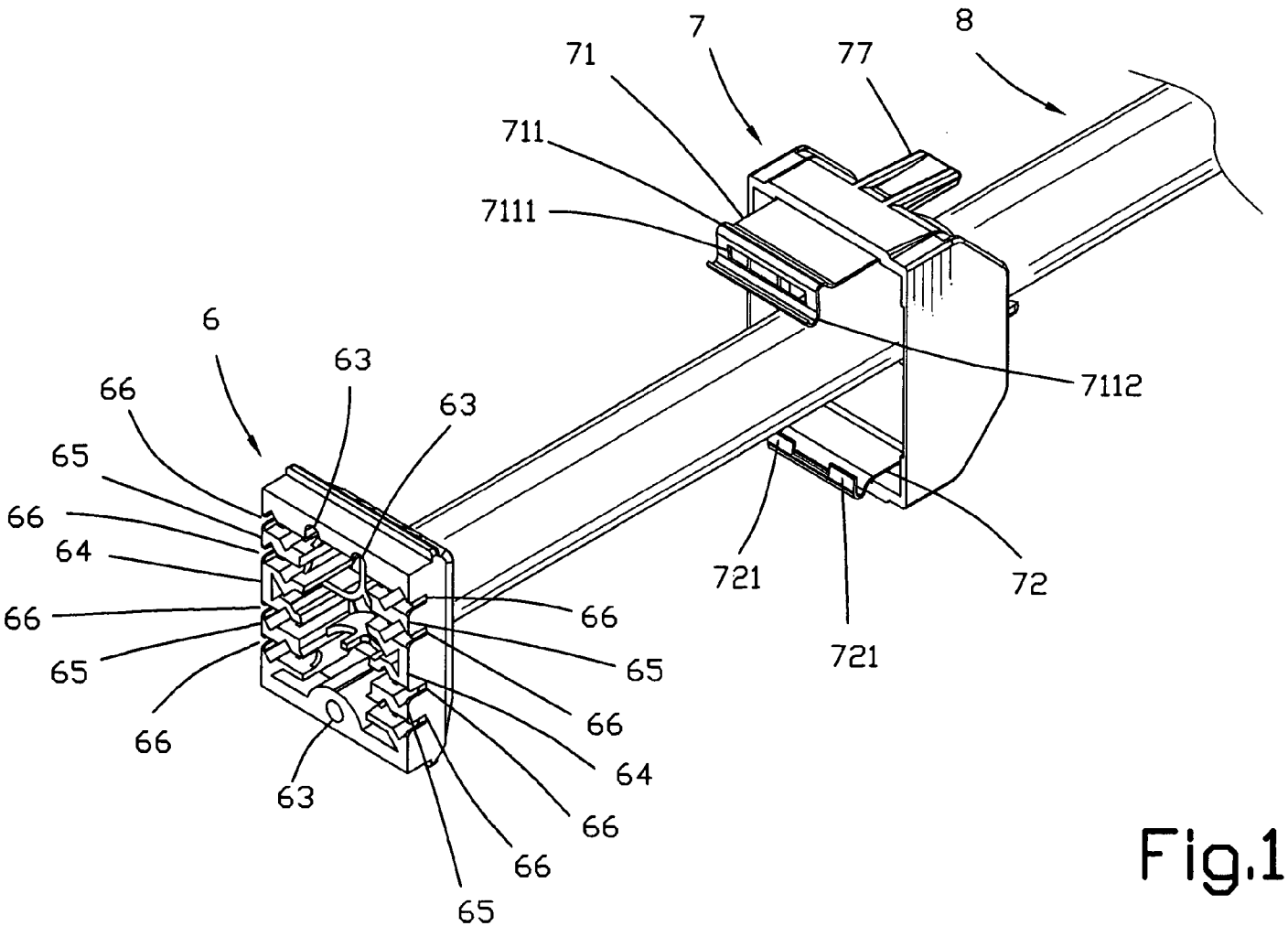
FIG. 12 illustrates the cable inserted through the metal shield into the cable organizer according to the present invention.
Figure 13:
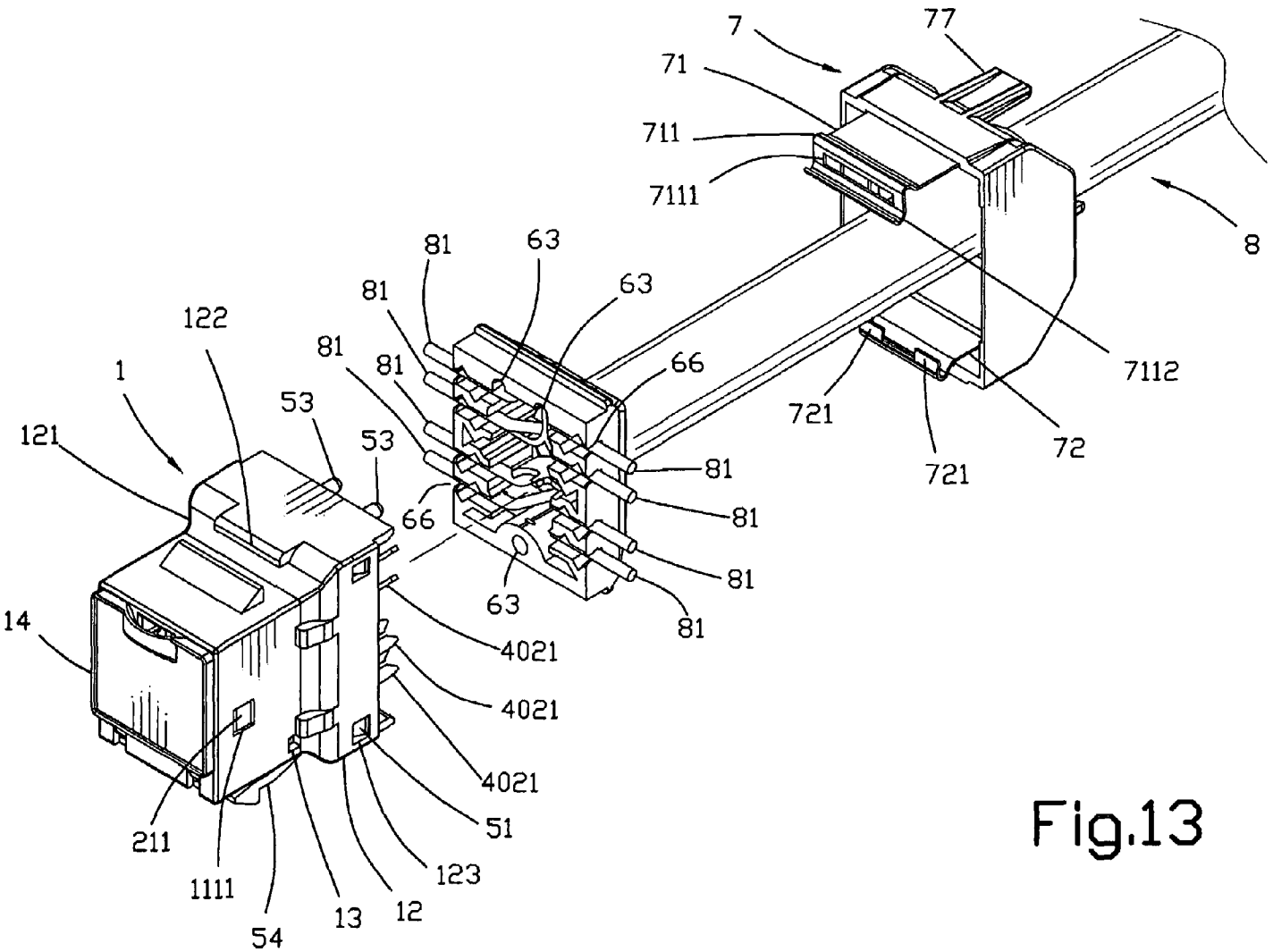
FIG. 13 illustrates the cable inserted through the metal shield and fastened to the cable organizer before fixation of the cable to the metal shield according to the present invention.
Figure 14:
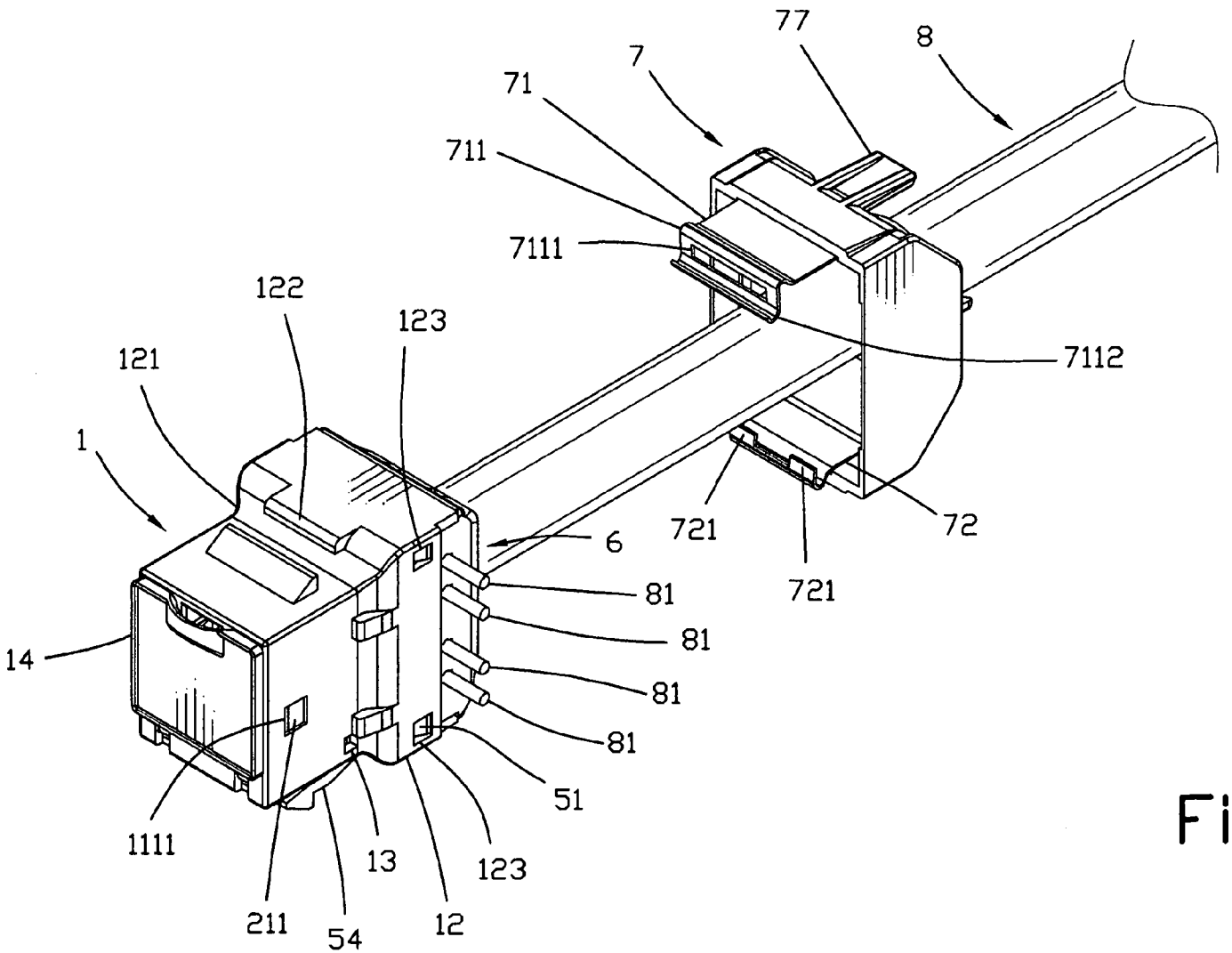
FIG. 14 is a schematic drawing showing the installation of the cable in the low crosstalk transmission connector according to the present invention.
Figure 15:
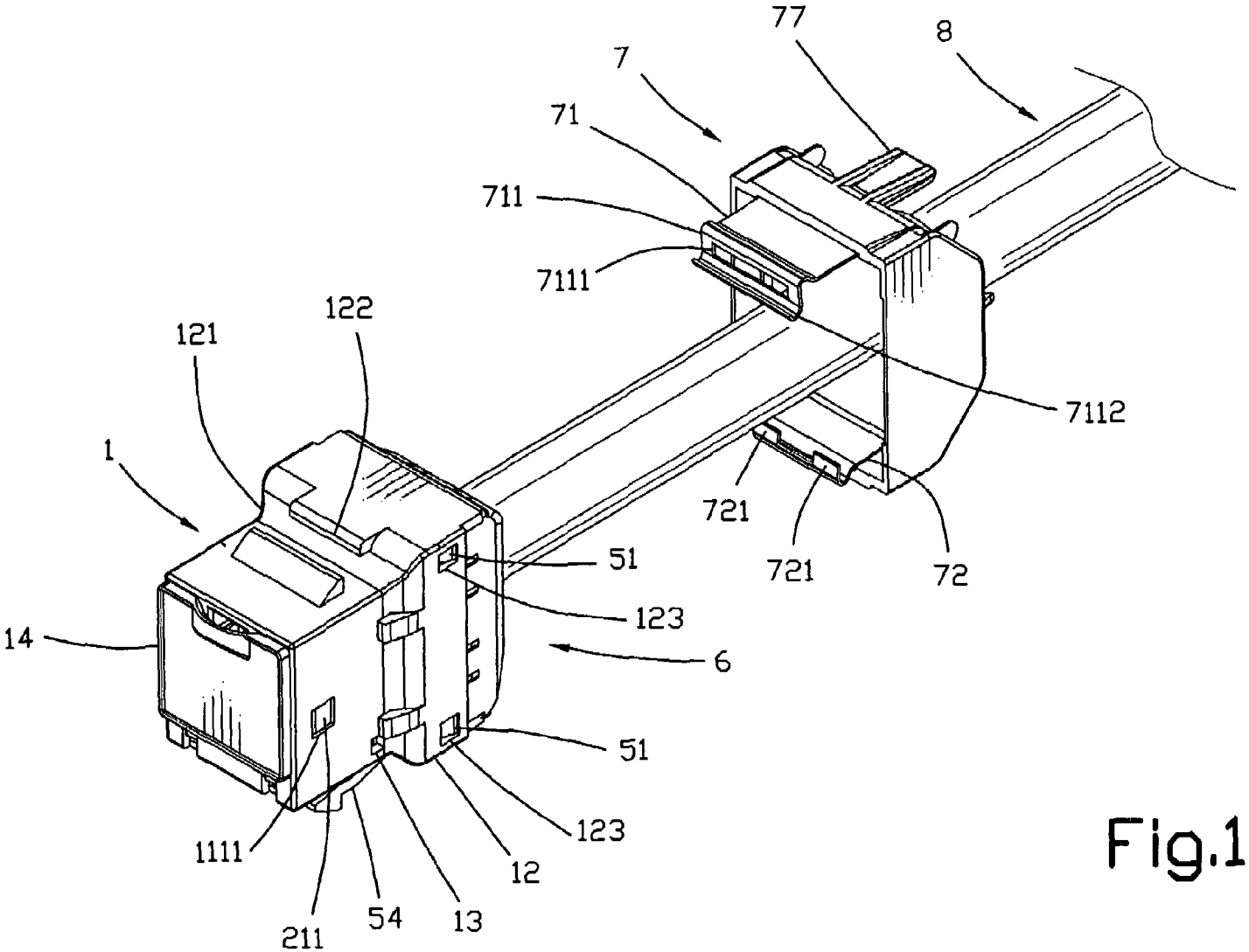
FIG. 15 is another schematic drawing showing the installation of the cable in the low crosstalk transmission connector according to the present invention.
Figure 16:
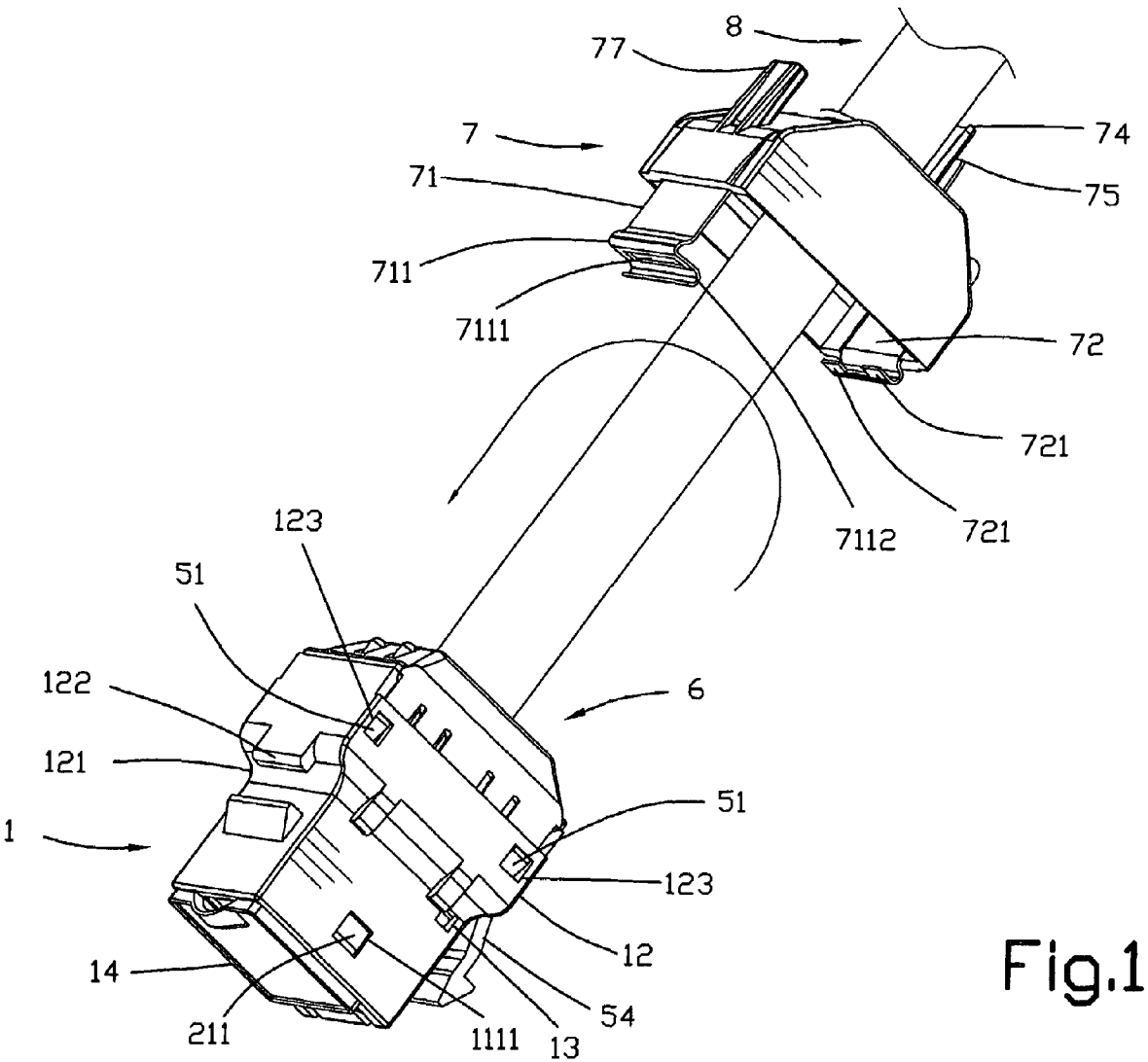
FIG. 16 is still another schematic drawing showing the installation of the cable in the low crosstalk transmission connector according to the present invention.
Figure 17:
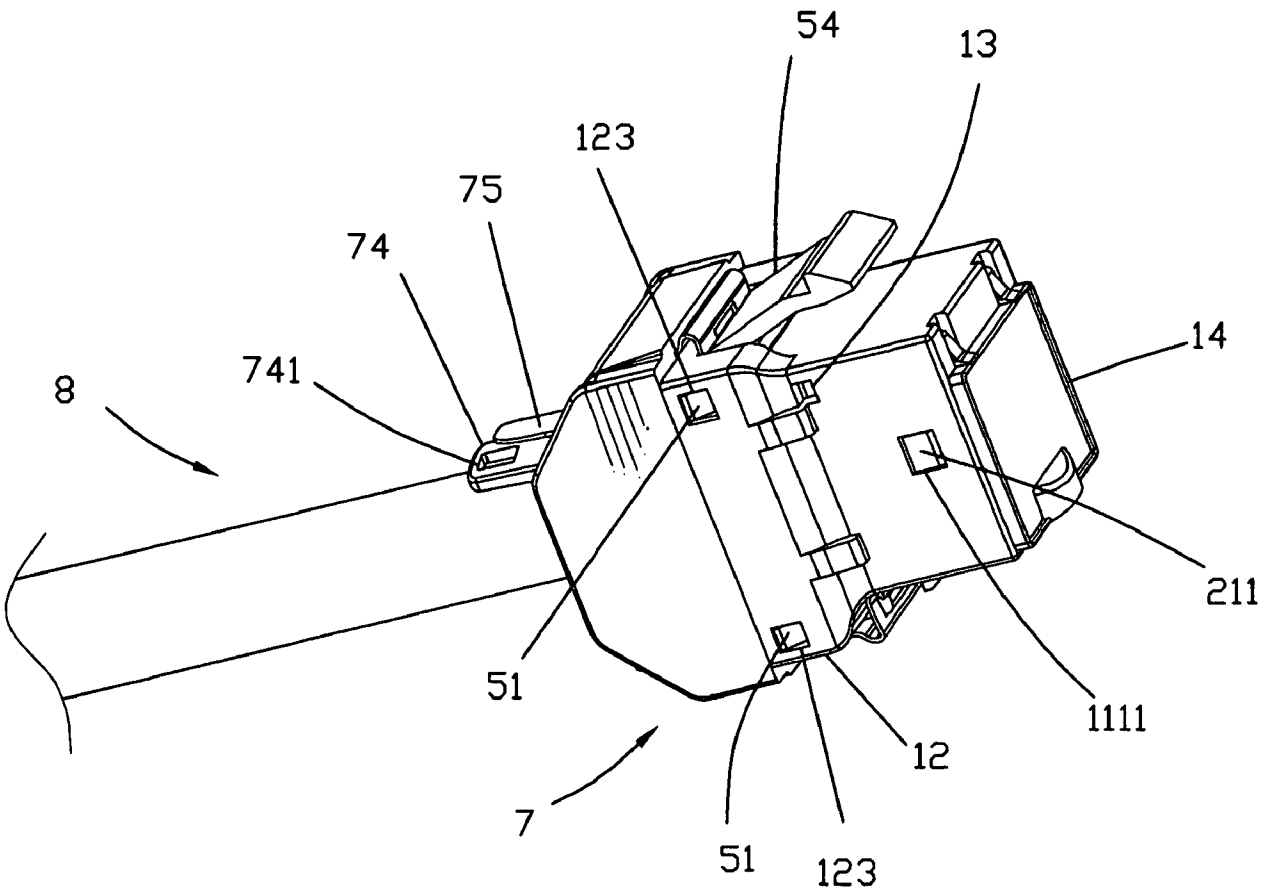
FIG. 17 shows the cable installed in the low crosstalk transmission connector according to the present invention.
Figure 18:
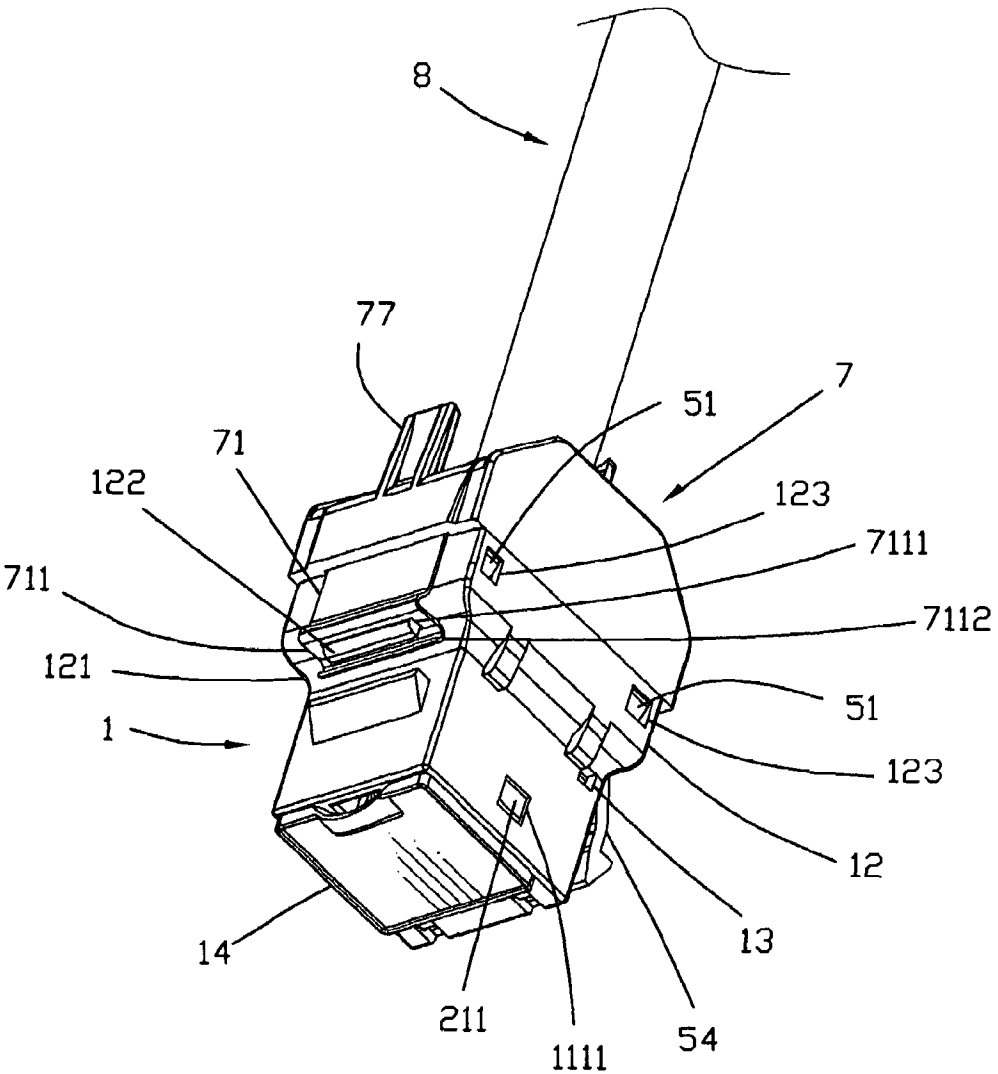
FIG. 18 corresponds to FIG. 17 when viewed from another angle.
Figure 19:
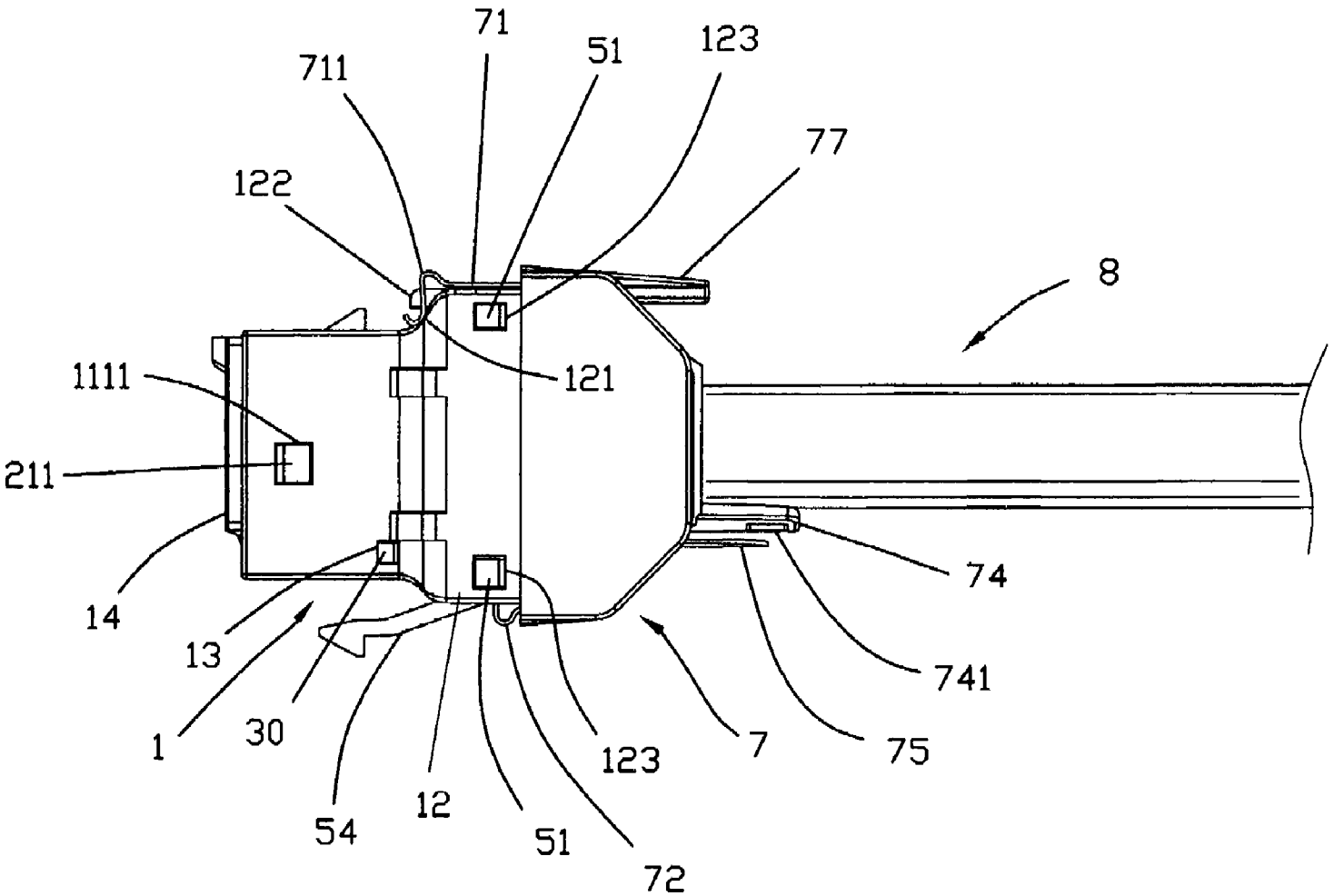
FIG. 19 is a side plain view of FIG. 18.

Referring to FIGS. 2~22, a low crosstalk transmission connector in accordance with the present invention is shown comprised of an electrically insulative housing 1, a metal spring plate 2, a load bar 3, a terminal module 4, a locating frame 5, a cable organizer 6, and a metal shield 7.

The housing 1 has in its rectangular front part a forwardly extending front insertion hole 11, two locating grooves 111 at the two opposite lateral sides of the insertion hole 11, two locating holes 1111 respectively cut through the two opposite lateral sidewalls of the rectangular front part in communication with the locating grooves 111, two stop blocks 112 bilaterally disposed inside the front insertion hole 11 (see FIGS. 5 and 9), and a positioning groove 113 in the bottom side inside the front insertion hole 11. The housing 1 further has a relatively greater rear part 12, a retaining groove 121 transversely extending at the top side of the rear part 12, a hook 122 suspending above the retaining groove 121, two bottom hook holes 124 on the bottom side of the rear part 12, two retaining holes 13 respectively cut through the two opposite lateral sidewalls of the rectangular front part adjacent to the rear part 12, a plurality of hook holes 123 respectively and symmetrically formed on the two opposite lateral sidewalls of the rear part 12 at different elevations, and a dust cover 14 hinged to the bottom edge of the front side of the rectangular front part for closing the front insertion hole 11.

The metal spring plate 2 has a transversely extending middle part 22 set inside the housing 1 and stopped at the stop blocks 112 (see FIG. 9), two side arms 21 respectively extended from the two distal ends of the transversely extending middle part 22 and bilaterally positioned inside the housing 1, and hooked tips 211 respectively extended from the side arms 21 remote from the transversely extending middle part 22 and respectively positioned in the locating grooves 111 inside the housing 1.

The load bar 3 is mounted inside the housing 1, having two retaining blocks 30 respectively protruded from the two opposite lateral sides thereof and respectively engaged into the two retaining holes 13 of the housing 1 (see FIGS. 3 and 9), and 8 terminal grooves number from 31, 32, 33, 34, 35, 36, 37, 38 arranged in parallel in proper order. The 4th terminal groove 34 and the 6th terminal groove 36 are relatively shorter than the other terminal grooves.

The terminal module 4 comprises a circuit board 40, and 8 metal contact terminals 41, 42, 43, 44, 45, 46, 47, 48. The circuit board 40 has 8 terminal slots 401 arranged in two rows at two different elevations in a staggered manner for the mounting of the 8 metal contact terminals 41, 42, 43, 44, 45, 46, 47, 48. The $1^{st}$, $3^{rd}$, $5^{th}$ and $7^{th}$ metal contact terminals 41, 43, 45 and 47 are respectively fastened to the 4 upper terminal slots 401. The $2^{nd}$, $4^{th}$, $6^{th}$ and $8^{th}$ metal contact terminals 42, 44, 46 and 48 are respectively fastened to the 4 lower terminal slots 401. The $1^{st}$, $3^{rd}$, $5^{th}$ and $7^{th}$ metal contact terminals 41, 43, 45 and 47 each have a rear mounting portion 411, 431, 451 or 471, and a front contact portion 412, 432, 452 or 472 sloping downwardly forwards. The $2^{nd}$ and $8^{th}$ metal contact terminals 42 and 48 each have a rear mounting portion 421 or 481, and a front contact portion 422 or 482 loping downwardly forwards. The $4^{th}$ and $6^{th}$ metal contact terminals 44 and 46 each have a rear mounting portion 441 or 461, and a front contact portion 442 or 462 curved upwardly backwards. The rear mounting portions 441 and 461 of the $4^{th}$ and $6^{th}$ metal contact terminals 44 and 46 are respectively fastened to the two inner ones of the lower terminal slots 401. The circuit board 40 further has 8 pierce terminals 402 bilaterally arranged at the back side at different elevations. The $4^{th}$ and $6^{th}$ metal contact terminals 44 and 46 are respectively inserted into the short $4^{th}$ and $6^{th}$ terminal grooves 34 and 36 of the load bar 3. The $1^{st}$, $2^{nd}$, $3^{rd}$ $5^{th}$, $7^{th}$ and $8^{th}$ metal contact terminals 41, 42, 43, 45, 47 and 48 are respectively inserted into the long $1^{st}$, $2^{nd}$, $3^{rd}$ $5^{th}$, $7^{th}$ and $8^{th}$ terminal grooves 34 and 36 of the load bar 3. The pierce ends 4021 of the pierce terminals 402 of the circuit board 40 are respectively inserted through the locating frame 5.

The locating frame 5 is mounted in the rear side of the housing 1, having a plurality of hook blocks 51 respectively protruded from the two opposite lateral sides and respectively engaged into the hook holes 123 of the housing 1 (see FIG. 3), 8 through holes 52 bilaterally disposed at different elevations for the passing of the pierce ends 4021 of the pierce terminals 402 of the circuit board 40, a plurality of locating rods 53 perpendicularly extended from the back wall for supporting the cable organizer 6, and a springy protruding plate 54 forwardly extended from the bottom side.

The cable organizer 6 has a plurality of mounting through holes 63 respectively fastened to the locating rods 53 of the locating frame 5, a center axle hole 62 for the passing of a cable 8, and a plurality of partition blocks 64 and 65 protruded from the front wall and defining 8 wire grooves 66 for separating the 8 insulated wires 81 of the cable 8.

Figure 20:
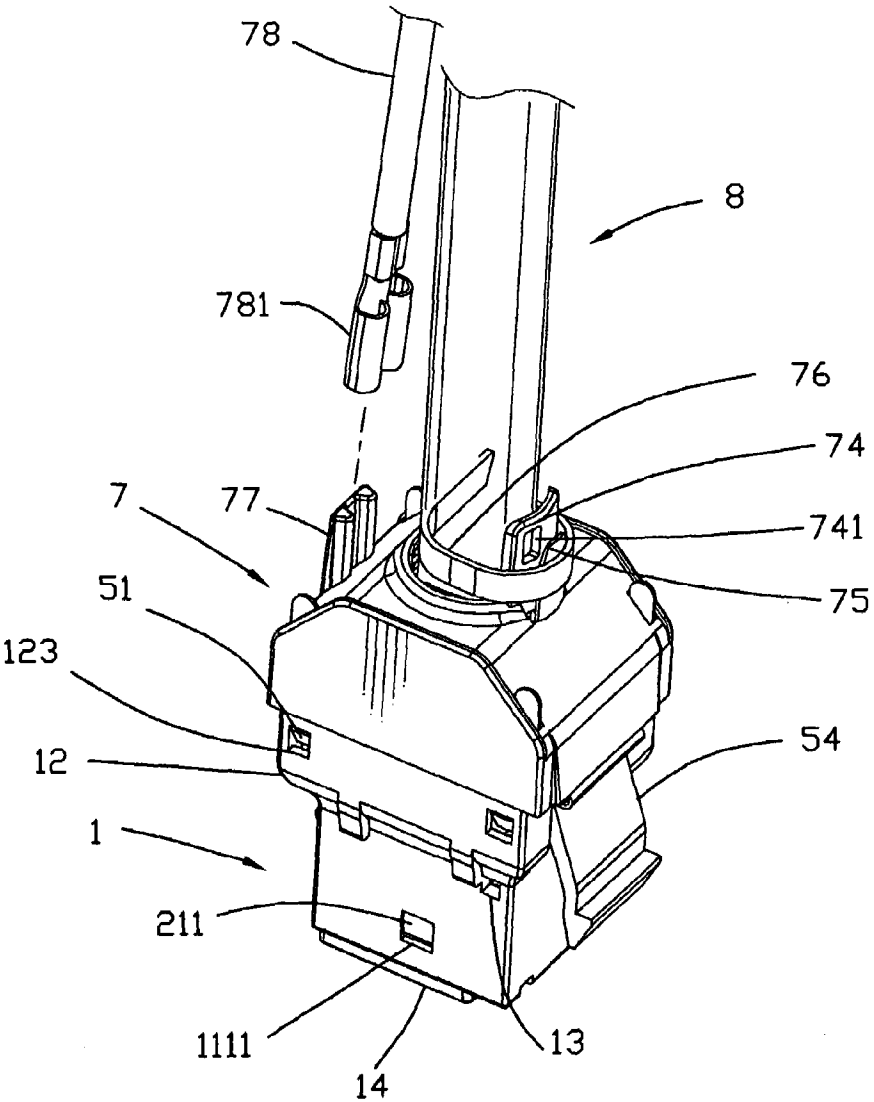
FIG. 20 illustrates the relationship between the grounding plate of the metal shield and the external grounding wire after installation of the cable in the low-crosstalk transmission connector according to the present invention.
Figure 21:
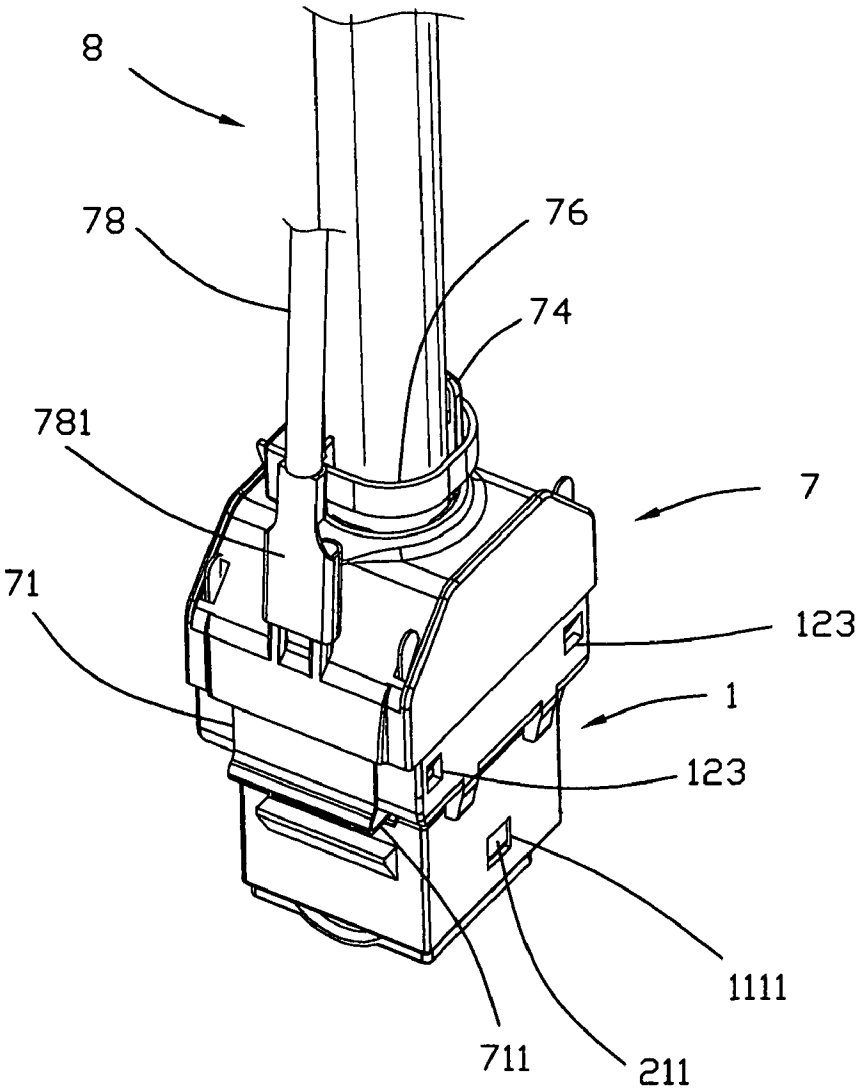
FIG. 21 corresponds to FIG. 21, showing the grounding plate of the metal shield connected to the grounding terminal of the external grounding wire.
Figure 22:
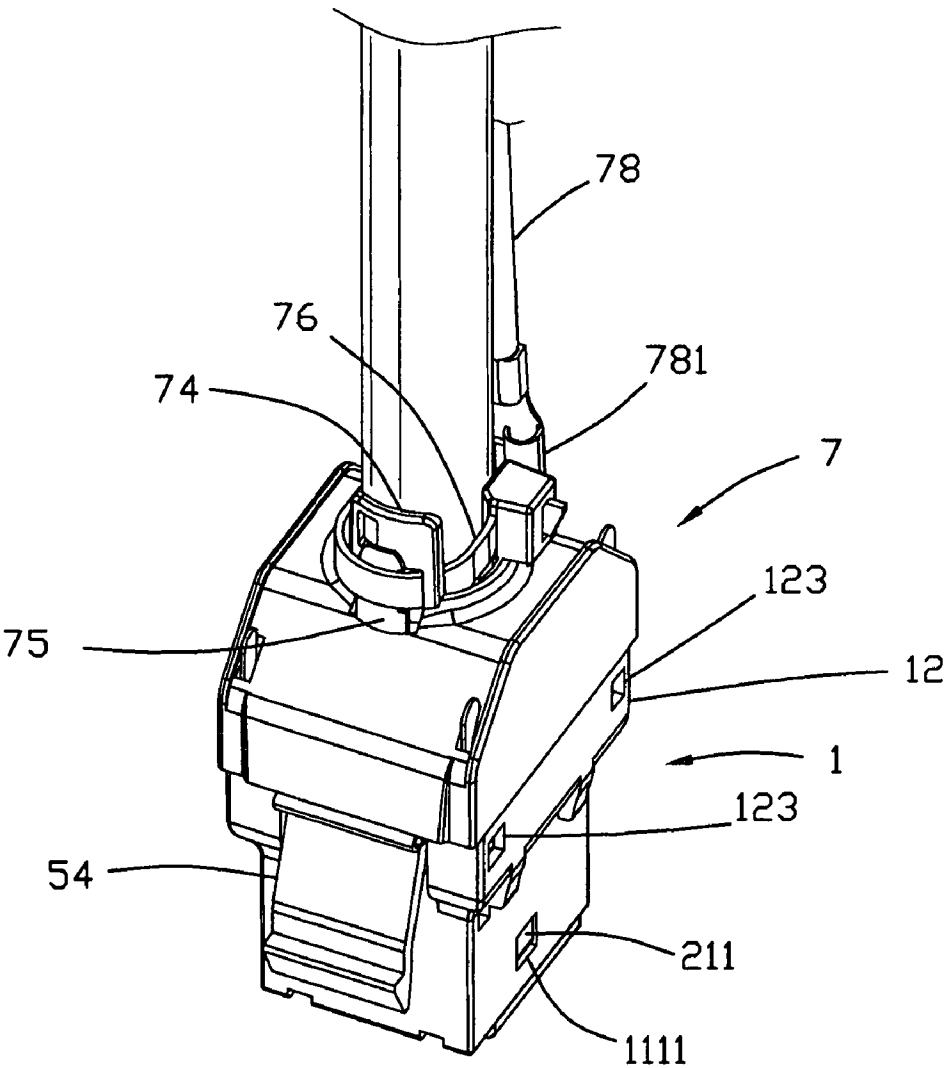
FIG. 22 corresponds to FIG. 21, showing the binding wire tired up.

The metal shield 7 has a front accommodation space 70 for accommodating said cable organizer 6, a center axle hole 73 in communication with the front accommodation space 70 for the passing of the cable 8, a top clamping plate 71 suspending at the top side of the front accommodation space 70 and having a hooked portion 711 defining a retaining groove 7111 (see FIG. 16), a bottom clamping plate 72 suspending at the bottom side of the front accommodation space 70 and having two upwardly curved hooked portions 721, two lugs 74 and 75 protruded from the back wall around the center axle hole 73 for supporting the cable 8, and a binding wire 76 inserted through a through hole 741 on one lug 74 to affix the cable 8 to the lugs 74 and 75 after insertion of the cable 8 through the center axle hole 73 (see FIGS. 20~22), and a grounding plate 77 extended from the back wall at the top for the connection of the grounding terminal 781 of a grounding wire 78 (see FIGS. 20~22).

During installation, the housing 1, the metal spring plate 2, the load bar 3, the terminal module 4 and the locating frame 5 are fastened together (see FIG. 10), and then the cable 8 is inserted through the center axle hole 73 of the metal shield 7 (see FIGS. 11 and 12), and then the 8 insulated wires 81 of the cable 8 are inserted through the center axle hole 62 of the cable organizer 6 and then respectively set in the 8 wire grooves 66 of the cable organizer 6 (see FIG. 13), and then the mounting through holes 63 of the cable organizer 6 are respectively fastened to the locating rods 53 of the locating frame 5 (see FIG. 14), and then the free ends of the 8 insulated wires 81 of the cable 8 are properly cut to the desired length (see FIG. 15), and then the upwardly curved hooked portions 721 of the bottom clamping plate 72 of the metal shield 7 is hooked in the bottom hook holes 124 (see FIG. 16), and then the lower portion 7112 of the hooked portion 711 of the top clamping plate 71 is engaged into the retaining groove 121 of the housing 1 to have the retaining groove 7111 be engaged with the hook 122 of the housing 1 (see FIGS. 16~19), and then the grounding plate 77 is fastened to the grounding terminal 781 of the grounding wire 78 (see s FIGS. 20 and 21), and then the binding wire 76 is fastened up to affix the cable 8 to the lugs 74 and 75.

As described above, the invention provides a low crosstalk transmission connector that has the features as follows:

1. After the housing 1 has been assembled with the metal spring plate 2, the load bar 3, the terminal module 4 and the locating frame 5, the cable 8 is inserted the metal shield 7 and the cable organizer 6 with the 8 insulated wires 81 properly set in the cable organizer 6, and then the bottom clamping plate 72 of the metal shield 7 is hooked in the bottom hook holes 124 of the housing 1 and the hooked portion 711 of the top clamping plate 71 is engaged into the retaining groove 121 of the housing 1 to have the retaining groove 7111 be engaged with the hook 122 of the housing 1, and therefore the transmission cable is getting high steadity.

2. The front contact portions 442 and 462 of the $4^{th}$ and $6^{th}$ metal contact terminals 44 and 46 and the front contact portions 412, 422, 432, 452, 472 and 482 of the $1^{st}$, $2^{nd}$, $3^{rd}$, $5^{th}$, $7^{th}$ and $8^{th}$ metal contact terminals 41, 42, 43, 45, 47 and 48 are curved in different directions to reduce crosstalk noise, thereby improving transmission quality.

3. During operation of the low crosstalk transmission connector, the metal shield 7 guides electromagnetic wave backwards to the ground through the grounding plate 77 and the grounding wire 78, preventing electromagnetic interference and ensuring high signal transmission quality.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A low crosstalk transmission connector, comprising:

a housing, said housing having a rectangular front part, a forwardly extending front insertion hole, two locating grooves at two opposite lateral sides of said insertion hole, two locating holes respectively cut through two opposite lateral sidewalls of said rectangular front part in communication with said locating grooves, a positioning groove in a bottom side inside said front insertion hole, a rear part relatively greater than said rectangular front part, a retaining groove transversely extending at a top side of said rear part, a hook suspending above said retaining groove, two bottom hook holes on a bottom side of said rear part, two retaining holes respectively cut through the two opposite lateral sidewalls of said rectangular front part adjacent to said rear part, and a plurality of hook holes respectively and symmetrically formed on the two opposite lateral sidewalls of said rear part at different elevations;

a metal spring plate mounted inside said housing, said metal spring plate having two side arms bilaterally positioned inside said housing and hooked tips respectively extended from said side arms and respectively positioned in the locating grooves inside said housing;

a load bar mounted inside said housing, said load bar having two retaining blocks respectively protruded from two opposite lateral sides thereof and respectively engaged into the two retaining holes of said housing, and 8 terminal grooves arranged in parallel, said terminal grooves being numbered from $1^{st}$ through $8^{th}$, the 4th terminal and the 6th terminal groove being relatively shorter than the $1^{st}$, $2^{nd}$, $3^{rd}$, $5^{th}$, $7^{th}$ and 8th terminal grooves;

a terminal module, said terminal module comprising a circuit board and 8 metal contact terminals, said circuit board having 8 terminal slots arranged in two rows at two different elevations in a staggered manner for the mounting of said 8 metal contact terminals and 8 pierce terminals bilaterally fastened to a back side thereof at different elevations, said pierce terminals each having a pierce end, the $1^{st}$, $3^{rd}$, $5^{th}$ and $7^{th}$ metal contact terminals of said 8 metal contact terminals being respectively fastened to the 4 upper terminal slots, the $2^{nd}$, $4^{th}$, $6^{th}$ and $8^{th}$ metal contact terminals of said 8 metal contact terminals being respectively fastened to the 4 lower terminal slots;

a locating frame mounted in a rear side of the rear part of said housing, said locating frame having a plurality of hook blocks respectively protruded from two opposite lateral sides thereof and respectively engaged into the hook holes of said housing, 8 through holes bilaterally disposed at different elevations for the passing of the pierce ends of said pierce terminals of said circuit board, a plurality of locating rods perpendicularly extended from a back wall thereof, and a springy protruding plate forwardly extended from a bottom side thereof;

a cable organizer, said cable organizer having a plurality of mounting through holes respectively fastened to the locating rods of said locating frame, a center axle hole for the passing of a cable having 8 insulated wires, and a plurality of partition blocks protruded from a front wall thereof and defining 8 wire grooves for separating the 8 insulated wires of the cable that is inserted through the center axle hole of said cable organizer; and a metal shield, said metal shield having a front accommodation space that accommodates said cable organizer, a center axle hole in communication with said front accommodation space for the passing of the cable to be inserted through the center axle hole of said cable organizer, a top clamping plate suspending at a top side of said front accommodation space, said top clamping plate having a hooked portion engaged into the retaining groove of said housing, the hooked portion of said top clamping plate defining a retaining groove, which is engaged with the hook of said housing, and a bottom clamping plate suspending at a bottom side of said front accommodation space, said bottom clamping plate having two upwardly curved hooked portions respectively hooked in the hook holes of said housing.

2. The low crosstalk transmission connector as claimed in claim 1, wherein the $1^{st}$, $3^{rd}$, $5^{th}$ and $7^{th}$ metal contact terminals of said terminal module each have a rear mounting portion and a front contact portion sloping downwardly forwards; the $2^{nd}$ and $8^{th}$ metal contact terminals of said terminal module each have a rear mounting portion and a front contact portion sloping downwardly forwards; the $4^{th}$ and $6^{th}$ metal contact terminals each have a rear mounting portion and a front contact portion 442 or 462 curved upwardly backwards; the rear mounting portions of the $4^{th}$ and $6^{th}$ metal contact terminals are respectively fastened to the two inner ones of the lower terminal slots of said circuit board.

3. The low crosstalk transmission connector as claimed in claim 1, wherein the $4^{th}$ and $6^{th}$ metal contact terminals of the terminal module are respectively inserted into the short $4^{th}$ and $6^{th}$ terminal grooves of said load bar; the $1^{st}$, $2^{nd}$, $3^{rd}$ $5^{th}$, $7^{th}$ and $8^{th}$ metal contact terminals of said terminal module are respectively inserted into the long $1^{st}$, $2^{nd}$, $3^{rd}$ $5^{th}$, $7^{th}$ and $8^{th}$ terminal grooves of said load bar; the pierce ends of the pierce terminals of said circuit board are respectively inserted through the 8 through holes of said locating frame into the 8 wire grooves of said cable organizer.

* * * * *